US005827793A

United States Patent [19]

Hu

[11] Patent Number: 5,827,793

[45] Date of Patent: Oct. 27, 1998

[54] CONTROLLED FCC CATALYST REGENERATION USING A DISTRIBUTED AIR SYSTEM

[75] Inventor: Albert Y. Hu, Baton Rouge, La.

[73] Assignee: Exxon Research and Engineering Company, Florham Park, N.J.

[21] Appl. No.: 634,494

[22] Filed: Apr. 11, 1996

[51] Int. Cl.[6] ..... B01J 38/30; B01J 38/12

[52] U.S. Cl. ..... 502/41; 502/38; 502/42

[58] Field of Search ..... 502/38, 41, 42; 208/113, 124

[56] References Cited

U.S. PATENT DOCUMENTS

| | | | |
|---|---|---|---|
| 4,377,470 | 3/1983 | Hettinger, Jr. et al. | 208/120 |
| 4,875,994 | 10/1989 | Haddad et al. | 208/113 |
| 5,001,096 | 3/1991 | Chu et al. | 502/65 |
| 5,006,495 | 4/1991 | Pappal et al. | 502/42 |
| 5,110,775 | 5/1992 | Owen | 502/43 |

OTHER PUBLICATIONS

O. Faltsi–Saravelou et al., "A Model for Fluidized Bed Simulation–II", Computers chem. Engng, vol. 15, No. 9, pp. 647–656, 1991 May.

R. Wormsbecher et al., "Vanadium Poisoning of Cracking Catalysts", Journal of Catalysis 100, 130–137 (1986) Feb.

*Primary Examiner*—Glenn Caldarola
*Assistant Examiner*—Alexander G. Ghyka
*Attorney, Agent, or Firm*—James H. Takemoto

[57] ABSTRACT

Spent FCC catalyst is regenerated under net reducing conditions in a regenerator to minimize the migration of vanadium on the spent FCC catalyst particles. Reducing conditions in at least the bottom 50% of the catalyst bed are maintained by using at least two air distribution grids located in the lower 50% of the catalyst bed.

5 Claims, 3 Drawing Sheets

CONTROLLED FCC CATALYST REGENERATION USING A DISTRIBUTED AIR SYSTEM

FIELD OF THE INVENTION

This invention relates to the regeneration of catalyst in a fluid catalytic cracking (FCC) process. More particularly, it relates to the regeneration of FCC catalyst which has been contaminated with vanadium.

BACKGROUND OF THE INVENTION

The use of the FCC process to convert heavy feeds into lighter more valuable products is well known in the art. For economic reasons, it is becoming increasingly more desirable for a refinery to process heavy crudes. Such heavy crudes when processed produce more "bottom of the barrel" products such as resids and residual oil fractions. These heavy oil fractions are normally converted into lighter products. Because resids have high concentrations of metals such as vanadium and nickel which poison the catalysts used in the FCC process, only small amounts of resids can be blended into a FCC feed without causing unacceptable losses in catalyst activity and selectivity. The same catalyst poisoning problem occurs with any feed stream which is high in metals content.

Nickel when deposited on a FCC catalyst promotes hydrogenation/dehydrogenation reactions which in turn lead to the production of large amounts of hydrogen, methane and other light gases. These reactions are very undesirable when they occur in a FCC. In addition to promoting the production of undesirable gases, vanadium also poisons catalysts by decreasing catalyst activity and catalyst selectivity towards desired products. Both metals lead to increased coke make. While the precise mechanism is not known with certainty, it appears that vanadium deactivates FCC catalysts by attacking the zeolite structure which is present in most FCC catalysts. Wormsbecher et al., Journal of Catalysis, (1988) 100, 130–137 suggest that volatile $H_3VO_4$ is produced under catalyst regeneration conditions (high temperature and steam) by the reaction of $V_2O_5$ with water. Vanadic acid is a strong acid and is thought to attack the zeolite structure by hydrolysis. The authors propose that adding a basic alkaline earth metal oxide such as MgO or CaO would act as a vanadium scavenger.

Other methods for controlling the poisoning effect of these metals have been proposed. One approach is to add antimony and/or tin as a metals passivator for nickel and to a lesser extent vanadium. Another approach is utilize a catalyst demetallizing process to remove metals from the FCC catalyst. Yet another approach is to add a scavenger which preferentially adsorbs metals from the feed. U.S. Pat. No. 4,377,470 discloses a process for regenerating coked catalyst in the presence of an oxygen-containing gas at a temperature high enough to burn off a portion of the coke under conditions keeping vanadium in an oxidation state less than +5. Most refiners control the problem by limiting the amount of metals in the FCC feed, by removing a certain percentage of FCC catalyst and replacing with fresh catalyst on an on-going basis, removing a fraction of circulating catalyst and cleaning it of metals prior to re-injection into the circulating catalyst stream, by modifying the catalyst to make it less susceptible to catalyst poisoning, adding guard beds or utilizing a multistage catalyst regeneration system.

In the regeneration process itself, coke is burned off spent FCC catalyst. Some units use partial CO burn conditions wherein coke is burned to CO and $CO_2$ by limiting the amount of air fed to the regenerator. However, this requires a CO boiler to remove CO from the flue gas. Thus, not all FCC units can operate in this mode. Other regenerators use full CO burn conditions wherein excess air is used to convert coke solely to $CO_2$.

It would be desirable to have a catalyst regeneration process which traps the vanadium on the catalyst in such a manner that it cannot migrate to catalytically active sites and which does not rely on any added chemicals.

SUMMARY OF THE INVENTION

It has been discovered that the migration of vanadium on FCC catalyst particles can be controlled by regenerating catalyst under reducing conditions. Accordingly the present invention relates to a process for regenerating spent catalyst from a fluidized catalytic cracker containing a stripper which catalyst has been contaminated by deposition of vanadium, nickel and coke thereon which comprises:

(a) conducting stripped spent catalyst from the stripper of the fluid catalytic cracker to a regenerator vessel to form a dense bed of spent catalyst particles in said regenerator;

(b) injecting an oxygen containing gas into a lower portion of said dense bed at a rate effective to maintain the spent catalyst particles in a fluidized state provided that the oxygen containing gas is distributed in at least two gas distribution grids, said grids being separated by an amount effective to maintain net reducing conditions in at least the bottom 50% of the dense bed of fluidized spent catalyst particles;

(c) maintaining the dense bed of fluidized spent catalyst particles under regeneration conditions including a temperature of from about 600° to 760° C.; and (d) removing regenerated catalyst from the regenerator vessel and recycling regenerated catalyst to the fluidized catalytic cracker.

DETAILED DESCRIPTION OF THE INVENTION

Figure 1:
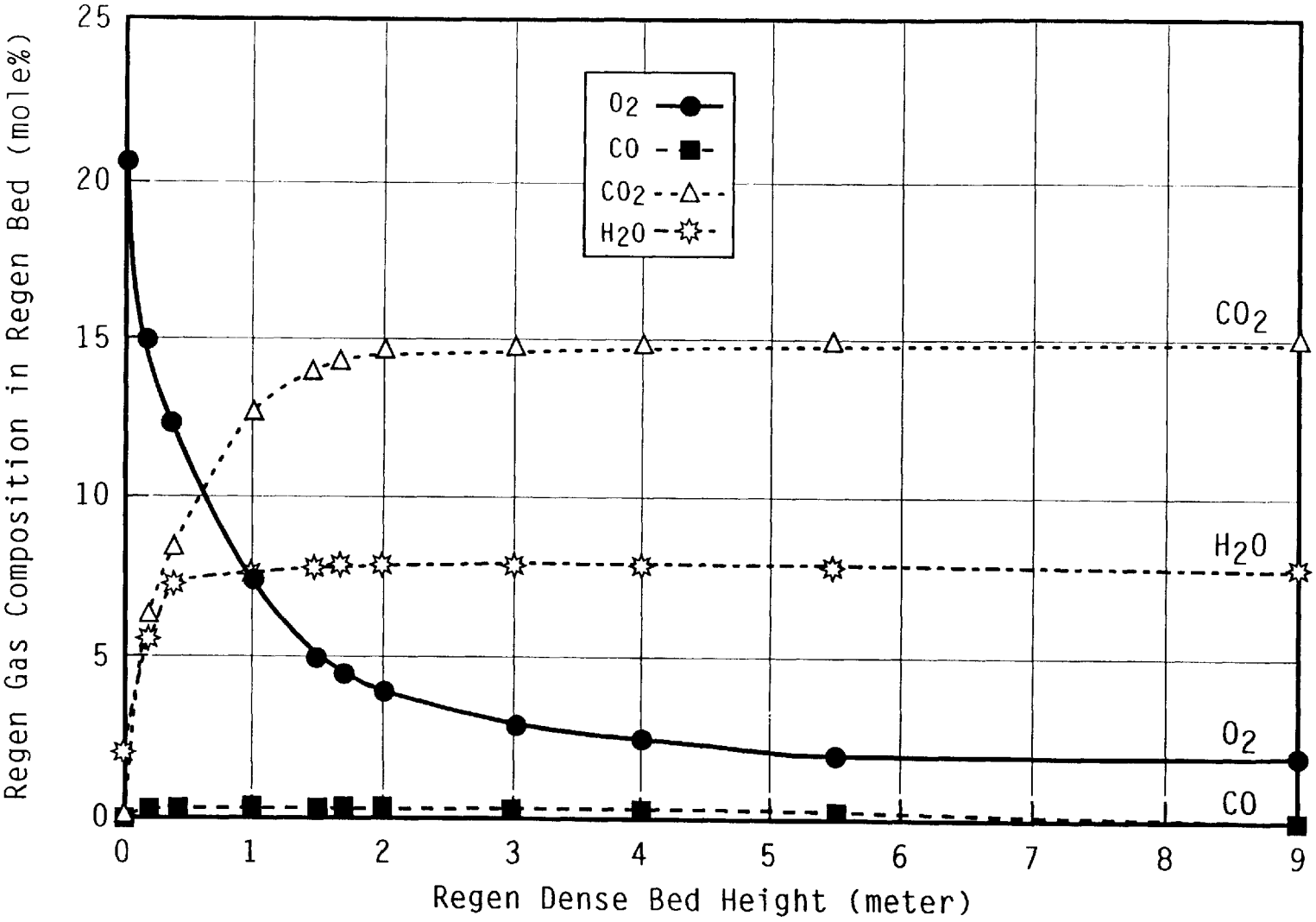
FIG. 1 is a gas composition profile for a conventional regenerator containing a single air distribution grid.

When hot catalyst particles are contacted with a feed containing vanadium in a FCC reactor, vanadium together with coke and other non-volatile metals are deposited on the particle surface. The spent catalyst particles are usually steam stripped and sent to a catalyst regenerator. Coke is burned off the catalyst particles in the regenerator. In a full burn regenerator, almost all the coke is burned to $CO_2$. Vanadium is oxidized under this oxidizing regeneration gas environment to vanadium pentoxide which, in the presence of steam, is converted to vanadic acid. Even under partial burn conditions, the catalyst will experience a strong oxidizing environment in the vicinity of the air injection grid at the bottom of the reactor. It is known that this acidic species has a limited vapor pressure which allows vanadium to migrate over the catalyst particle surface or to other catalyst particles. This in turn allows vanadium to reach zeolites within the catalyst particles which leads to eventual collapse of the zeolites.

The process according to the invention relates to the discovery that the migration of vanadium deposited on spent FCC catalyst particles can be controlled during regeneration by maintaining the regenerator under net reducing conditions. Maintaining a regenerator under net reducing conditions minimizes the formation of vanadium pentoxide and thus vanadic acid on spent catalyst particles from the FCC reactor. This in turn limits vanadium's mobility which reduces the opportunity for vanadium to migrate to zeolite sites either in the same particle or in other catalyst particles thereby lessening the structural damage to active zeolite sites.

The regenerator can be maintained mostly under net reducing conditions in a full CO burn regenerator. Air which may be spiked with oxygen is added to the regenerator to create an oxygen rich condition thereby burning coke to $CO_2$. According to the present process, it is possible to maintain a net reducing condition by distributing air at different levels within the bed of catalyst particles in the regenerator to control the regenerator gas environment such that there will be very low oxygen and high CO concentration in at least the bottom 50% of the catalyst bed even under full burn conditions. By introducing air into the regenerator at different levels in the catalyst bed, the CO and $O_2$ concentrations can be regulated to achieve a net reducing environment in at least the bottom 50% of the catalyst bed. It has been discovered that catalyst deactivates three times faster under an oxidizing environment as compared to a reducing environment.

A typical FCC regenerator uses a single air distribution grid located in the lower portion of catalyst bed. Air is conducted through the bottom of the regenerator into the distribution grid located near the bottom and flue gas exits throught the top of the regenerator after passing through the catalyst bed to be regenerated. In the present process, air or other oxygen containing gas will be distributed in at least two different levels in the catalyst bed within the regenerator by using at least two air distribution grids. In this manner, the total air entering the regenerator will be split between the several layers of distribution grids. The number of air distribution grids is at least two, preferably at least three. The first grid will be located at the bottom of the catalyst bed to be regenerated, and the rest of the grids will be located in the lower 50%, preferably the lower 70% of the catalyst bed to be regenerated. Such air distribution grids are well known in the art, e.g., Gary and Handwerk, "Petroleum Refining", Marcel Dekker, New York, 1994, Chapter 6. The air distribution grids will preferably be evenly spaced within said lower portion of the catalyst bed, although some deviation in spacing is allowable. The distance between grids is a function of the number of grids and the portion of total height of the catalyst bed to be regenerated which is occupied by the grids. For example, if there are four air distribution grids which occupy the lower 50% of the catalyst bed of total height of 20 meters, each grid will be roughly 3 meters apart. There should be enough bed height in the top portion of the catalyst bed to fully combust any CO to $CO_2$ so as to avoid any after-burn problems. The feed rate of air or other oxygen containing gas is preferably evenly proportioned between the grids. Preferably 30 to 80% of the air required for full CO combustion should enter through the lowest grid and the remaining air distributed between the remaining grid or grids. the total rate of air injection should be sufficient to burn off all the coke on the spent catalyst. The regenerator temperature is between 600° to 760° C., and the catalyst residence time is between 1 to 10 min. The gas velocity at the bottom of the catalyst bed should be high sufficient to maintain a minimin fluidized bed. The spent catalyst is preferably injected into the lower portion of the spent catalyst bed in the regenerator and the regenerated catalyst is preferably removed through an overflow well located in the upper portion of the spent catalyst bed and is preferably on the opposite side from the point of entry of spent catalyst into the regenerator.

The catalyst can be any catalyst which is typically used to catalytically "crack" hydrocarbon feeds. It is preferred that the catalytic cracking catalyst comprise a crystalline tetrahedral framework oxide component. This component is used to catalyze the breakdown of primary products from the catalytic cracking reaction into clean products such as naphtha for fuels and olefins for chemical feedstocks. Preferably, the crystalline tetrahedral framework oxide component is selected from the group consisting of zeolites, tectosilicates, tetrahedral aluminophophates (ALPOs) and tetrahedral silicoaluminophosphates (SAPOs). More preferably, the crystalline framework oxide component is a zeolite.

Zeolites which can be employed include both natural and synthetic zeolites. These zeolites include gmelinite, chabazite, dachiardite, clinoptilolite, faujasite, heulandite, analcite, levynite, erionite, sodalite, cancrinite, nepheline, lazurite, scolecite, natrolite, offretite, mesolite, mordenite, brewsterite, and ferrierite. Included among the synthetic zeolites are zeolites X, Y, A, L, ZK-4, ZK-5, B, E, F, H, J, M, Q, T, W, Z, alpha and beta, ZSM-types and omega.

In general, aluminosilicate zeolites are effectively used. However, the aluminum as well as the silicon component can be substituted for other framework components. For example, the aluminum portion can be replaced by boron, gallium, titanium or trivalent metal compositions which are heavier than aluminum. Germanium can be used to replace the silicon portion.

The catalytic cracking catalyst can further comprise an active porous inorganic oxide catalyst framework component and an inert catalyst framework component. Preferably, each component of the catalyst is held together by attachment with an inorganic oxide matrix component.

The active porous inorganic oxide catalyst framework component catalyzes the formation of primary products by cracking hydrocarbon molecules that are too large to fit inside the tetrahedral framework oxide component. The active porous inorganic oxide catalyst framework component of this invention is preferably a porous inorganic oxide that cracks a relatively large amount of hydrocarbons into lower molecular weight hydrocarbons as compared to an acceptable thermal blank. A low surface area silica (e.g., quartz) is one type of acceptable thermal blank. The extent of cracking can be measured in any of various ASTM tests such as the MAT (microactivity test, ASTM # D3907-8). Compounds such as those disclosed in Greensfelder, B. S., et al., *Industrial and Engineering Chemistry*, pp. 2573–83, November 1949, are desirable. Alumina, silica-alumina and silica-alumina-zirconia compounds are preferred.

FIG. 1 shows a simulated gas composition profile for a typical conventional regenerator containing a single air distribution grid and operated in the full burn mode similar to the simulation given in Computers Chem. Engng., Vol. 15, No. 9, pp 647–656, 1991. As can seen from FIG. 1, the composition of the gases produced in the regenerator changes most rapidly in the first half of the dense bed height. FIG. 1 indicates that the catalyst will experience high concentrations of both $O_2$ and steam, i.e., an oxidative environment in practically the entire catalyst bed, and a very low CO concentration, i.e., in order of 0.3 vol. % or less These conditions favor the migration of vanadium due to oxidation of vanadium and subsequent reaction with steam to form vanadic acid which in turn leads to catalyst deactivation.

Figure 2:
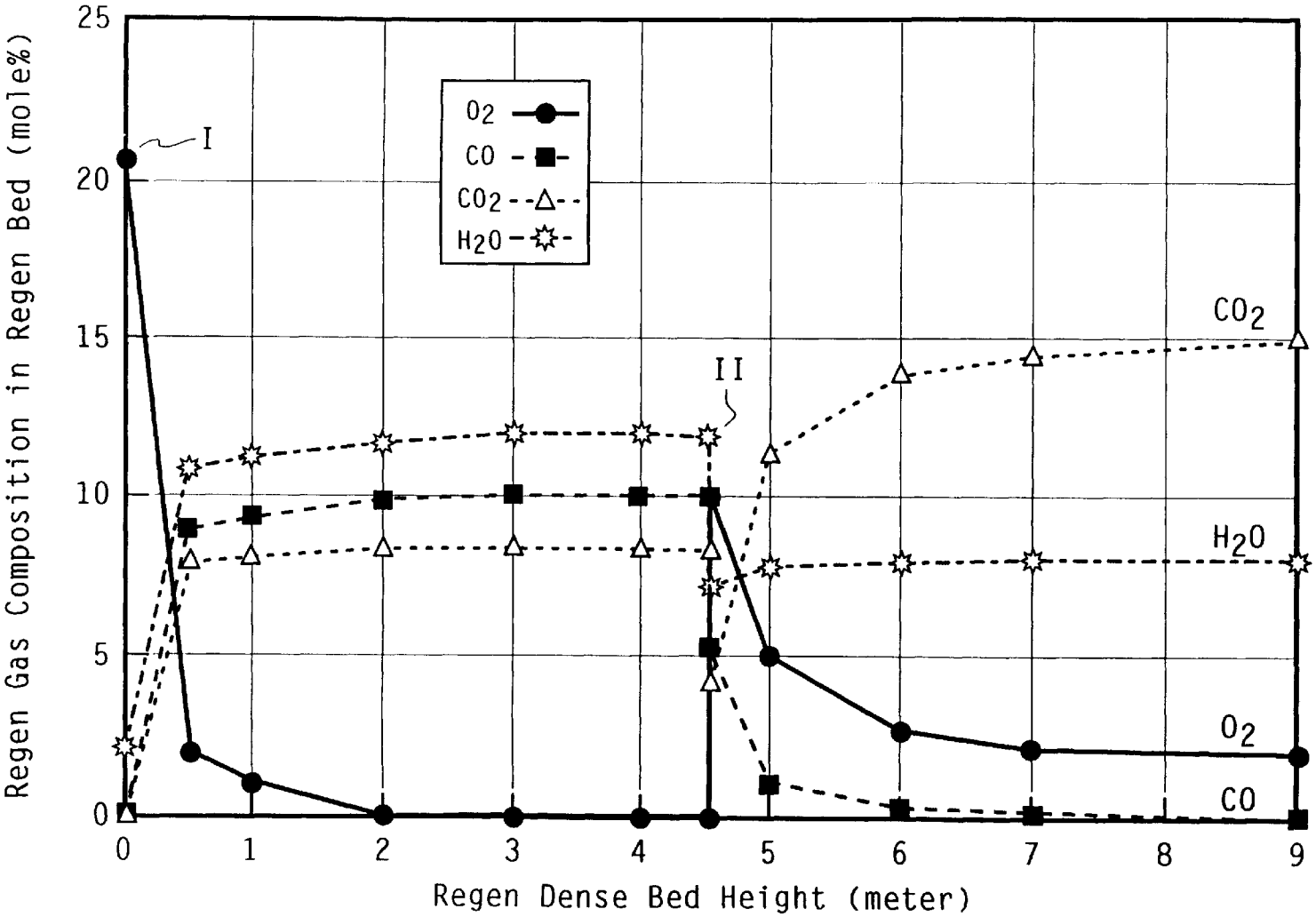
FIG. 2 is a gas composition profile for a regenerator containing two air distribution grids according to the invention.

FIG. 2 shows a simulated gas composition profile for a regenerator according to the invention containing two air distribution grids designated as I and II. In contrast to FIG. 1, this figure shows that the oxygen concentration in the bottom half of the regenerator is much less while the CO level rises rapidly in the first half of the bed to about 10 vol. % before one-half bed height is reached. FIG. 2 indicates that the catalyst below the top air grid level sees a mostly net reducing environment which is the case for a partial CO burn unit. This minimizes oxidation of vanadium thereby limiting migration of vanadium to catalyst active sites. Thus the catalyst is protected against vanadium poisoning.

Figure 3:
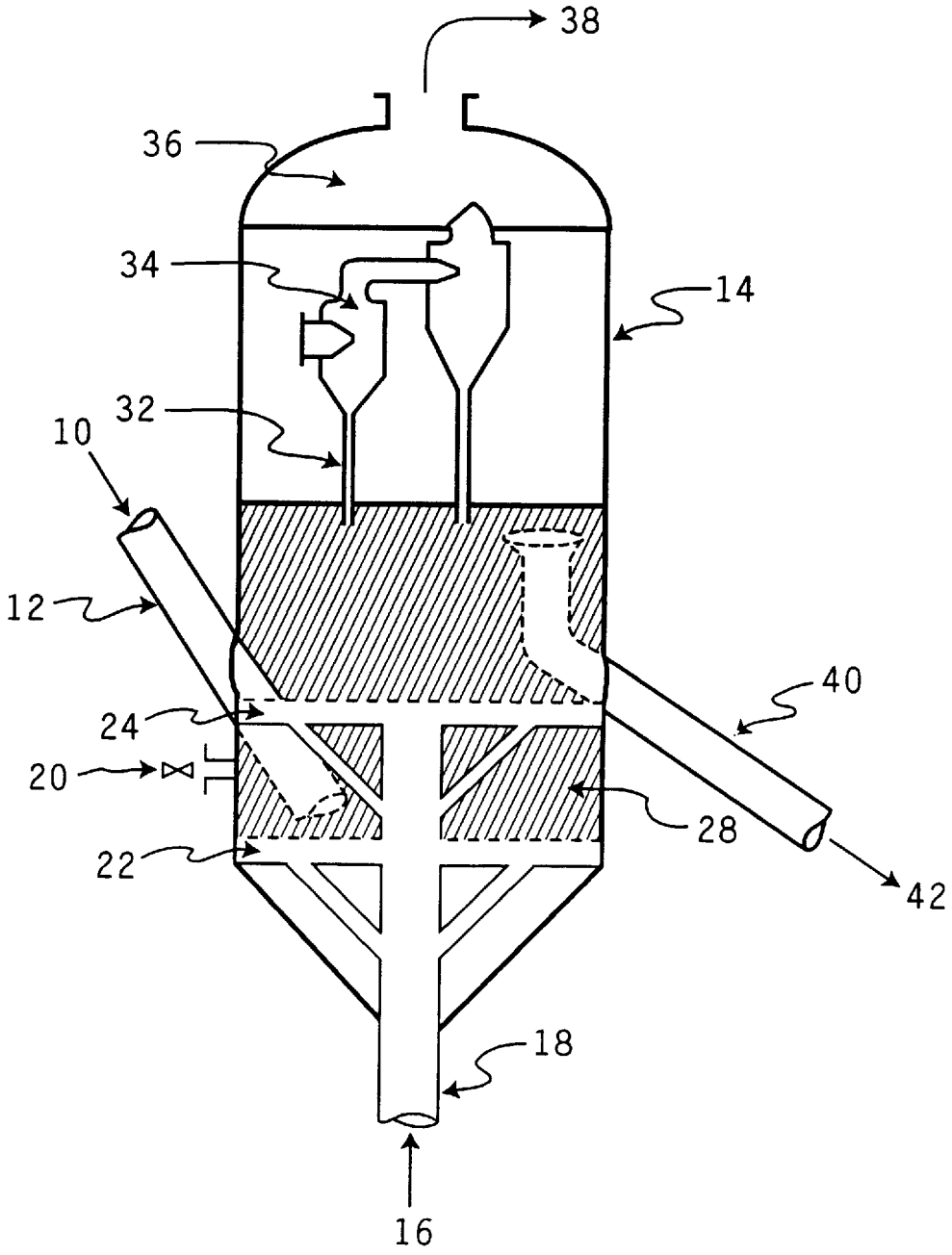
FIG. 3 is a vertical cross-section of a FCC regenerator with multiple gas distribution grids.

The process of the invention is further illustrated in FIG. 3. Stripped spent catalyst 10 from the FCC reactor (not shown) is conducted to regenerator 14 through reactor standpipe 12. Torch oil for startup may be added through valve 20. Regeneration air 16 is added to the regenerator 14 through conduit 18. Regeneration air is distributed through air distribution grids 22 and 24 into catalyst bed 28 which is maintained at the desired temperature. Coke is burned off catalyst particles and flue gases containing $O_2$, $CO_2$, $H_2O$ and CO, if any, enter cyclone 34. The proportions of $CO_2$ and CO in the flue gas are a function of burn conditions. Catalyst particles are separated from flue gas in cyclone 34, catalyst particles returned to the catalyst bed through dip leg 32 and flue gas enters plenum chamber 36 and may be further treated in a downstream gas treat unit through line 38. Regenerated catalyst exits reactor 14 through standpipe 40 and is conducted back to The FCC reactor through line 42.

What is claimed is:

1. A process for regenerating spent catalyst from a fluidized catalytic cracker containing a stripper which catalyst has been contaminated by deposition of vanadium, nickel and coke thereon which comprises:

(a) conducting stripped spent catalyst from the stripper of the fluid catalytic cracker to a regenerator vessel to form a dense bed of spent catalyst particles in said regenerator;

(b) injecting an oxygen containing gas into a lower portion of said dense bed at a rate effective to maintain the spent catalyst particles in a fluidized state provided that the oxygen containing gas is distributed in at least two gas distribution grids, said grids being located in the bottom 50% of the dense bed of catalyst particles and separated by an amount effective to maintain net reducing conditions in at least the bottom 50% of the dense bed of fluidized spent catalyst particles;

(c) maintaining the dense bed of fluidized spent catalyst particles under regeneration conditions including a temperature of from about 600° to 760° C.; and (d) removing regenerated catalyst from the regenerator vessel and recycling regenerated catalyst to the fluidized catalytic cracker.

2. The process of claim 1 wherein the regenerator is maintained under full CO burn conditions.

3. The process of claim 1 wherein the number of air distribution girds is at least three.

4. The process of claim 1 wherein the oxygen containing gas is air.

5. The process of claim 1 wherein the grids are approximately evenly spaced in said lower portion of the catalyst bed.

* * * * *